United States Patent [19]

Delmas et al.

[11] Patent Number: 4,662,794

[45] Date of Patent: May 5, 1987

[54] FACING IN THE FORM OF PLATES FOR THE BANK OF EARTHEN FORMATIONS, PARTICULARLY SOIL MASSES REINFORCED BY GEOTEXTILE SHEETS

[75] Inventors: Philippe Delmas, Bougival; Josè Puig, Toulouse; Marc Schaeffner, Orsay, all of France

[73] Assignees: Laboratorie Central des Ponts et Chaussees, Paris; MUR EBAL, Toulouse, both of France

[21] Appl. No.: 770,296

[22] Filed: Aug. 27, 1985

[30] Foreign Application Priority Data

Aug. 28, 1984 [FR] France ..... 84 13301

[51] Int. Cl.[4] ..... E02D 17/20; E02D 29/02

[52] U.S. Cl. ..... 405/258; 405/284; 405/286

[58] Field of Search ..... 405/258, 284, 285, 286, 405/287

[56] References Cited

U.S. PATENT DOCUMENTS

| | | | |
|---|---|---|---|
| 3,570,253 | 3/1964 | Vidal | 405/284 |
| 4,067,166 | 1/1978 | Sheahan | 405/284 X |
| 4,117,686 | 10/1978 | Hilfiker | 405/284 |
| 4,329,089 | 5/1982 | Hilfiker et al. | 405/262 |

*Primary Examiner*—David H. Corbin

*Attorney, Agent, or Firm*—Shenier & O'Connor

[57] ABSTRACT

This invention relates to a facing for the bank of earthen formations, particularly soil masses reinforced by geotextile sheets, said facing being composed of plates individually hooked to the bank by supple hooking elements, and the plates are disposed in substantially horizontal rows, the plates of one row partially overlapping the plates of the row immediately therebeneath.

8 Claims, 3 Drawing Figures

FACING IN THE FORM OF PLATES FOR THE BANK OF EARTHEN FORMATIONS, PARTICULARLY SOIL MASSES REINFORCED BY GEOTEXTILE SHEETS

The present invention relates to the finishing of earthen formations, particularly of reinforced soil masses.

Soils are building materials of low cost, but of relatively modest mechanical characteristics compared with those of other materials used in civil engineering, such as steel or concrete, which, on the other hand, are much more expensive.

This is why engineers have always sought to increase the mechanical characteristics of soils in order to be able to use them competitively in works or parts of works in which these soils, in their natural state, ought to be rejected.

To this end, numerous techniques have been studied and widely developed; this is particularly the case for treatment with binding agents, such as cement, lime, bitumen, and for the inclusion of metal reinforcing elements placed in position during construction, such as for "reinforced earth", or after construction, such as for "nailing".

Geotextiles which are relatively inexpensive products of the textile industry, in the form of weaves, non-woven fabrics, grids or composites between these different products, have appeared in recent years and have been used in assocation with the soils firstly as anti-contaminating layers, as filters and as drains.

It has furthermore been ascertained that, among these geotextiles, many present sufficiently high tensile strengths to envisage using them as mechanical reinforcing elements in an earthen formation under construction, similarly to what is already produced with metal bands in the case of the reinforced earth technique mentioned above.

In fact, if sheets of geotextiles are interposed between the different horizontal strata of an embankment under construction, they become tensioned, under the combined effect of the weight of the earth and of the coefficient of friction between ground and geotextile, as soon as the slope of the bank is greater than the angle of repose, corresponding to the material in question. If the tensile strength of the geotextile, the coefficient of friction between ground/geotextile, and the number of sheets interposed are correctly dimensioned, the slope of the embankment may be rendered steep as desired, until the vertical is attained.

This, briefly, is the general principle of the reinforcement of earthen formations, using metal reinforcements or sheets of geotextiles.

The interest of the technique of soil masses reinforced with sheets of geotextiles is primarily economic, but also technical: this is particularly the case of supporting works called upon to deform because they are established on unstable soils in place. In fact, the suppleness of the works produced with this technique makes it possible to adapt to the deformations of the soils in place, whilst works made of concrete for example, which are therefore much more rigid, would not support them.

Finally, like any novel technique, it opens up perspectives both in the design of new types of works, and in the production of equipment which could not be economically envisaged with the conventional techniques.

For example, mention may be made of safety earth works, barrages, anti-noise walls, terraces for use at sports- and playgrounds, terraces in industry, agriculture, etc.

Numerous works of this type have been constructed throughout the world, but these are works of relatively modest importance, often experimental or temporary.

There is a considerable gap in the solutions to the problem of facing such works, for which either a total absence of facing, leaving the reinforcing geotextile to the mercy of the various aggressions that it may undergo, is observed, or expensive solutions in the form of walls of concrete or masonry, which counterbalance the economically attractive nature of such works and, in numerous cases, their suppleness.

It is an object of the present invention to propose a facing which does not present these drawbacks but which is, on the contrary, able to satisfy, simultaneously and at optimum cost, the following three functions:

protecting the reinforcing geotextile from the aggressions that it may undergo during the life of the work: ultra-violet rays, vandalism, various mechanical aggressions, etc . . .

allowing the principal work to deform and adapting to such deformations, which, in certain cases, may be relatively considerable;

offering an attractive aesthetic appearance adaptable to the different sites where such works may be constructed (open country, mountain, urban zone, etc . . . ).

The object of the invention is attained thanks to a facing composed of plates individually hooked to the bank, in their upper part, by supple hooking elements, and said plates are disposed in substantially horizontal rows, the plates of one row partially overlapping the plates of the row immediately therebeneath.

In this way, the supple hooking and relative disposition of the plates enables said plates to slide on one another, and to follow the deformations of the work which might develop in the three directions.

This facing is adaptable to all geometries of works (bank: vertical or not, straight or in tiers; profile in plan: rectilinear or curved, etc . . . ) as well as to the various requirements (particularly aesthetic) imposed by the environment.

The plates are made of concrete, metal, plastics material, wood or any other material.

The supple hooking elements are elements which are flexible in at least one direction. They may be constituted by cables, metal blades, flexible grid, geotextile sheet, etc.

The plates of one horizontal row are advantageously offset laterally with respect to the plates of the row immediately therebeneath, in order better to protect the bank.

The supple hooking elements advantageously comprise adjacent rigid horizontal bars articulated on one another in two's, the lower bar being articulated on a rigid plate.

The supple hooking elements advantageously comprise a flexible grid.

For a mass composed of strata of earth reinforced by sheets of geotextile of which the end edges form the bank, the plates advantageously comprise in their upper part flexible hooking elements of which an end part is anchored between two strata of earth.

The plates may be positioned as the work is mounted, and may even partially participate in the production of the formwork.

They may also be implanted, once the work has been partially or completely finished, insofar as the sheets of geotextile have been maintained in readiness at the interface of the strata, after which it will be possible by any appropriate means to hook them, or even by fixing them directly on the visible part of the reinforcing geotextile.

This facing technique is generally applicable to all earthen formations, reinforced or not, if there is a difficult problem of protection of the bank (erosion, surface stability). In that case, it suffices to provide, during construction, the anchoring in the bank of hooking elements (in particular grids or sheets of geotextiles) projecting slightly from the bank and on which it will be possible to hook the plates.

The shape of the plates may be adapted to the appearance which it is desired to give the facing: from the simple rectangular flat plate to the architectonic element for decorating an urban site.

The invention relates not only to the facing, but also to each individual plate adapted to form this facing: this plate, which is rigid or semi-rigid and substantially rectangular, comprises in its upper part flexible hooking elements comprising an end part in the form of a flexible grid and an intermediate part formed by articulated bars.

The flexible grid advantageously continues inside the articulated bars and the plate of which it forms the reinforcement.

The invention will be more readily understood on reading the following description with reference to the accompanying drawings, in which.

Figure 3:
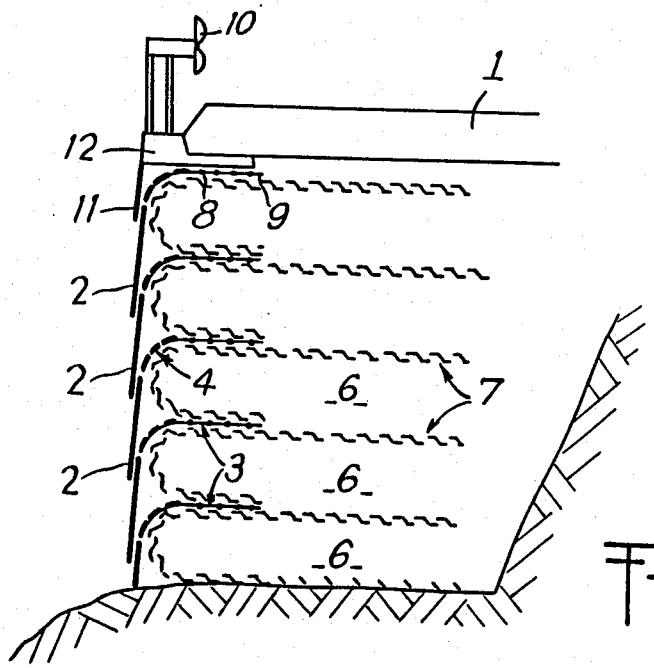

FIG. 3 schematically shows, in transverse section through the bank, the arrangement and fixation of the plates to the earthen formation.

Figure 1:
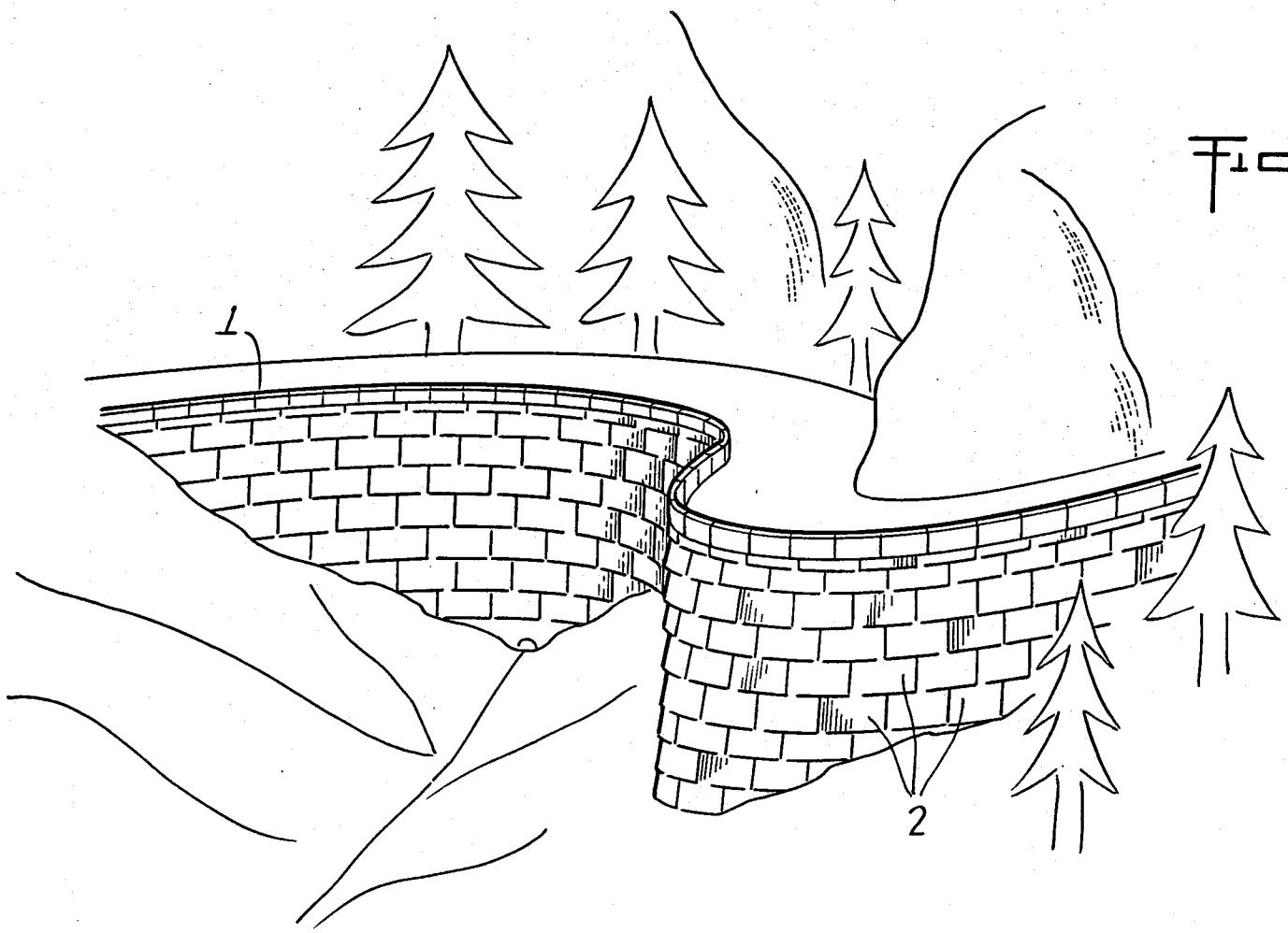
FIG 1 shows in perspective the facing of a complex work, made according to the invention.

Referring now to the drawings, FIG. 1 shows a mass in steeply sloping ground, intended to support a highway 1 and of which the bank is covered with a facing composed of plates 2 disposed in horizontal rows. The plates of one row slightly overlap in quincunx the plates of the row immediately therebeneath, somewhat like a slate or plane tile roof.

The plates 2, generally flat and rectangular in shape, extend in their upper part by a supple element for hooking to the bank.

This supple element comprises an end part 3 in the form of a supple grid, for example made of plastics material and an intermediate part 4 formed by articulated bars 5.

Production of assembly 2, 3, 4, 5 includes the preparation of a supple grid which serves not only to form the end part 3, but also the inner reinforcement of the plates 2 and the bars 5 which it is desired to cast around the grid. Consequently, the plates 2 and the bars 5 are connected together in supple manner by the "warp" elements 9 of the grid.

Figure 2:
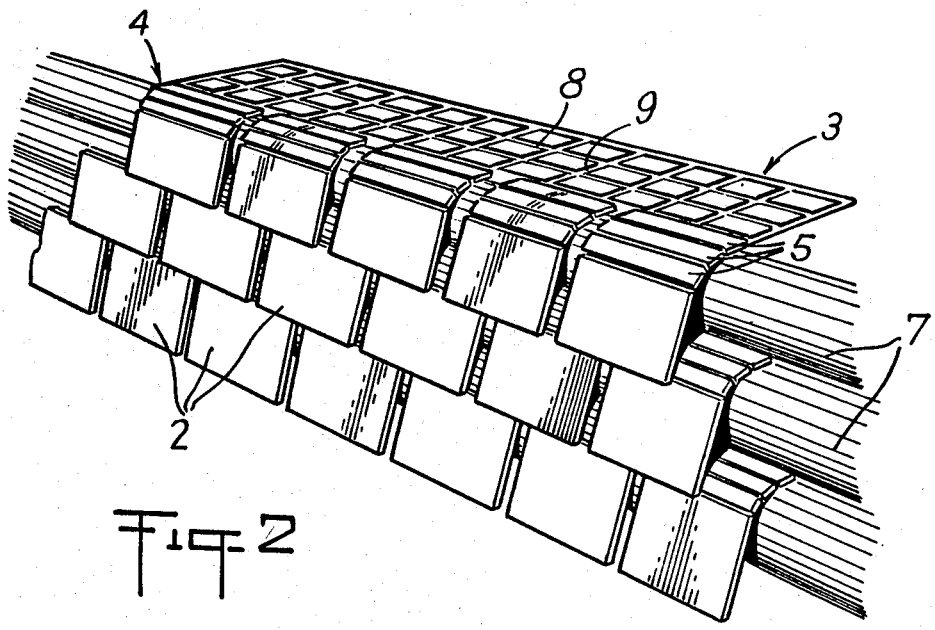
FIG. 2 shows in perspective the arrangement of the superposed rows of plates according to the invention.

The same grid may serve to produce several adjacent plates (cf. FIG. 2). The "weft" elements 8 of the grid connecting the adjacent plates may be broken in order not to hinder relative displacement of the adjacent plates.

The earth formation may advantageously be constructed in accordance with the technique described in French Patent Application No. 84 13300 of Aug. 28, 1984 filed by Applicants. It comprises strata of earth 6 reinforced by sheets of geotextiles 7. The bank is formed by the superposed end edges of the sheets of geotextiles.

According to the invention, the end part 3 in grid form of the supple hooking elements is interposed, when the earthen formation is being constructed, between two superposed strata. The friction and deformation of the sheets 7 of geotextile against the grid 3 immobilize the latter and therefore effect hooking of the plates 2 which depend thereon.

Displacement of the plates 2 due to a deformation of the edges of the bank under the thrust of the earth remains possible thanks to the supple hooking according to the invention. Furthermore, the overlapping of the plates 2 and the presence of the bars 5 reduce the exposure of the edges to outside action (sun's rays, bad weather) to a minimum and ensure long-life of the bank.

Of course, the upper part of the earthen formation comprises, in addition to the highway 1, the conventional elements such as a curb 12 which may support, on the one hand, safety rails 10 and, on the other hand, special facing plates 11 adapted to cover the top row of the plates 2 according to the invention.

The invention is naturally applicable to masses of earth or similar materials such as industrial waste, etc.

What is claimed is:

1. A facing for the bank of a mass of earth held in position by a suitable retaining means including in combination a plurality of horizontal rows of relatively rigid plates and a plurality of supple hooking elements for individually hooking said plates to said bank with the plates of one row partially overlapping the plates of the row immediately therebelow so that the plates of said one row partially cover the plates of said row immediately therebelow, said supple hooking elements permitting displacement of said plates relative to each other to accommodate deformation of said bank.

2. The facing of claim 1, wherein the plates of one horizontal row are offset laterally with respect to the plates of the row immediately therebeneath.

3. The facing of either one of claims 1 or 2, wherein the supple hooking elements are elements which are flexible at least in one direction.

4. The facing as in claims 1 or 2, wherein the supple hooking elements comprise adjacent rigid horizontal bars articulated on one another in two's, the lower bar being articulated on a rigid plate.

5. The facing as in claims 1 or 2, wherein the supple hooking elements comprise a flexible grid.

6. A facing as in claims 1 or 2 in which the mass of earth comprises strata, said retaining means comprises sheets of geotextile material retaining the earth making up the respective strata so that the edges thereof form said bank and in which said hooking elements have ends which are anchored between two of said strata.

7. A facing as in claims 1 or 2 in which said plates are substantially rectangular and in which said flexible hooking elements comprise an end part in the form of a flexible grid and an intermediate part formed by articulated bars.

8. A facing as in claim 7, wherein the flexible grid continues inside the articulated bars and the plate of which it forms the reinforcement.

* * * * *